US005794610A

United States Patent [19]

Facchina

[11] Patent Number: 5,794,610

[45] Date of Patent: Aug. 18, 1998

[54] FREE STANDING FIREPLACE

[76] Inventor: Joan E. Facchina, 19441 Noel Rd., Elwood, Ill. 60421

[21] Appl. No.: 759,519

[22] Filed: Dec. 4, 1996

[51] Int. Cl.[6] ..... F24C 3/00

[52] U.S. Cl. ..... 126/512; 126/93; 431/125

[58] Field of Search ..... 126/512, 96, 92 R, 126/92 AC, 500, 92 A, 86.93; 431/125, 126, 150, 151, 331, 332

[56] References Cited

U.S. PATENT DOCUMENTS

| | | | |
|---|---|---|---|
| D. 71,761 | 2/1926 | Nieberding . | |
| D. 78,469 | 5/1929 | Lawson . | |
| 457,081 | 8/1891 | Grant . | |
| 485,079 | 10/1892 | Backus . | |
| 501,356 | 7/1893 | McGahan . | |
| 627,787 | 6/1899 | Wessalosky et al. . | |
| 1,079,686 | 11/1913 | Backus | 126/512 |
| 1,596,456 | 8/1926 | Sala | 126/512 |
| 4,573,905 | 3/1986 | Meyers . | |
| 4,653,464 | 3/1987 | Kojima et al. . | |
| 4,726,351 | 2/1988 | Whittaker et al. . | |
| 4,748,967 | 6/1988 | Smith . | |
| 4,838,781 | 6/1989 | Fischer | 431/125 |
| 4,890,600 | 1/1990 | Meyers . | |
| 4,958,619 | 9/1990 | Kardas . | |
| 5,263,471 | 11/1993 | Shimek et al. . | |

*Primary Examiner*—James C. Yeung
*Attorney, Agent, or Firm*—Terrance L. Siemens

[57] ABSTRACT

An operable, knockdown flueless fireplace for installation in rooms and buildings not originally intended to accommodate a fireplace. The fireplace has a thin walled, cast metal facade comprising a front face, two sides, a mantel, and a hearth. Each component of the facade has flanges bearing holes formed therein for enabling bolted assembly of the fireplace. At least one of these components of the facade is ornamented to include sculpted features in bas relief of Victorian or antique appearance. The fireplace also has a firebox open to the front of the fireplace and closed at the top, a horizontal grate for supporting artificial logs, a front grate, and a bottom grate. Apparatus for burning gelled alcohol fuel is housed in the firebox within a dedicated holder having a lid for extinguishing combustion.

7 Claims, 5 Drawing Sheets

FREE STANDING FIREPLACE

BACKGROUND OF THE INVENTION

1. Field of the Invention

The present invention relates to fireplaces, and more particularly to a free standing, self-contained fireplace requiring no chimney. The novel fireplace comprises external cabinet sections bolted together, and burns alcohol based fuel which requires no chimney or analogous system. The cabinet sections, when placed abutting a wall, open only towards an observer. No openings are present for discharge of exhaust gasses.

2. Description of the Prior Art

A fireplace is a highly enjoyable feature in a house, which adds warmth, light, sound sensations, and generally instills a feeling reminiscent of homes and lifestyles of prior years. Formerly, most houses in North America, Europe, and many other places were originally provided with fireplaces. However, due to certain inefficiencies of fireplaces, these devices have been replaced by central heating systems. Central heating systems have the advantage of being economical in fuel consumption, are automatic in their operation, and generally prevent products of combustion from entering living spaces.

Thus, although houses enjoy these advantages, they are deprived of psychological rewards of fireplaces. The prior art has implicitly and explicitly recognized this failing in several ways. One way is that superseding heating devices intentionally simulate traditional wood burning fireplaces in various aspects. U.S. Pat. No. 485,079, issued to Frederick E. Backus on Oct. 25, 1892, describes a flueless gas burning fireplace. Apart from assuming the general configuration of a fireplace, this device has features for simulating traditional wood burning fireplaces. One simulated feature is artificial logs. Another is simulated andirons which in actuality conduct water for a radiant heat feature. The device of Backus lacks modular construction seen in the present invention. Backus's device also requires gas piping for its burner, as opposed to alcohol gel dispensers employed in the present invention.

U.S. Pat. No. 457,081, issued to Oscar F. Grant on Aug. 4, 1891, shows a gas burning device which may be located in a fireplace opening of a building. Grant illustrates modular construction utilizing bolts passing through flanges of abutting members of the device.

U.S. Pat. No. 501,356, issued to Fred L. McGahan on Jul. 11, 1893, describes an oil burner which may be located in a fireplace opening of a building. McGahan illustrates a traditional front appearance of a fireplace, including such elements as a mantel. McGahan requires oil supply piping and exhausting of combustion products, both features not being found in the present invention.

U.S. Pat. Nos. 4,573,905 and 4,890,600, issued to Wayne E. Meyers on Mar. 4, 1986, and Jan. 2, 1990, respectively, describe burners for simulated fireplaces. Meyers utilizes gelled alcohol fuel, which enables the fireplace to avoid provision of an exhaust disposing system. However, Meyers fails to disclose construction features and ornamentation found in the present invention. Notably, flanges for bolting the principal fireplace sections to one another and to a building wall are not shown by Meyers.

U.S. Pat. No. 4,958,619, to Kardas, describes a portable, flueless space heater which burns hydrocarbon fuel and is capable of limiting nitrogen oxides and carbon monoxide. Kardas fails to teach modular construction of the present invention, and attachment to a building wall.

None of the above inventions and patents, taken either singly or in combination, is seen to describe the instant invention as claimed.

SUMMARY OF THE INVENTION

The present invention provides a modular fireplace simulating both visual and dynamic features of Victorian age fireplaces. These features include both external architecture and ornamental facade of these fireplaces, and also most of the visual and audible sensory stimulation of actual fires. This is accomplished in a device which may be installed in a room or building not originally intended to accommodate a fireplace.

The present invention overcomes structural limitations of absence of a flue and chimney by consuming gelled alcohol fuel. This type of fuel, being essentially an oxygenated hydrocarbon, burns substantially to completion at moderate temperatures. Thus, carbon monoxide, hydrocarbons, nitrogen oxides, smoke and similar particulates, and ash are minimized or eliminated, although actual combustion occurs. There is no need for a flue or chimney to exhaust products of combustion.

Massive structural reinforcement of the floor is obviated since the invention can simulate a full scale fireplace while weighing less than some human adults.

To these ends, the novel fireplace comprises five principal external structural modular members which are bolted together. These members include an ornamented frontal facade, or face, two lateral side members, a mantel, and a hearth. Optionally, the lateral side members and mantel may be ornamented. A firebox modified project light and heat forwardly from the fireplace is provided internally to these external structural members, although the firebox is visible through the front opening.

Ornamentation is provided by bas relief sculpting of uncomplicated geometric designs or motifs on the outer, exposed surfaces of the ornamented members. The designs or motifs are preferably taken from styles in vogue at or prior to the Victorian age, so that a dominant visual effect is antique or Victorian. Ornamentation is preferably further enhanced by patina and similar surface treatment to the ornamented members.

The principal members are preferably cast from metals, such as copper and its brass and bronze alloys, iron, and aluminum. The principal members are of only nominal thickness, there being sufficient metal to present an uninterrupted surface, but thin enough to limit weight of each member and of the assembled fireplace. Each member has a flange having a hole formed therein. Bolts may be inserted through the holes of appropriately aligned flanges in order to assemble the principal members. Preferably, sufficient flanges are provided appropriately to enable bolting the hearth member to the fireplace, and to enable bolting the assembled fireplace to the wall, if desired.

The principal members are complemented by minor members such as a front grate, bottom grate, and an optional simulated arrangement of wooden branches or twigs for placement in the firebox. The latter is sufficiently durable to be disposed within flames without undergoing significant deterioration.

The combustion system provides replaceable canisters filled with gelled alcohol fuel. These are located inconspicuously within the firebox, contained within a dedicated canister holder such that they are reasonably accessible for service, but are not overly detrimental to dynamic simulation of a traditional wood or coal burning fireplace. A cooperating lid fits onto the canister holder for extinguishing the fire. Thus, the novel fireplace is fully functional, in the sense of accommodating actual combustion, while being antique or Victorian in appearance, modular in construction, and not requiring exhausting of products of combustion.

Accordingly, it is a principal object of the invention to provide a fireplace suitable for installation and operation in a room or building not originally built to accommodate a fireplace.

It is another object of the invention to provide Victorian or antique ornamentation to the novel fireplace.

It is a further object of the invention to provide front and side facades, a mantel, and a hearth formed from members of nominal thickness, so that weight is minimized.

Still another object of the invention is to provide flanges which have holes formed therethrough, and which can be aligned to assemble the fireplace by receiving bolts.

An additional object of the invention is to provide antique or Victorian ornamentation to the fireplace.

It is again an object of the invention to enable the fireplace to accommodate combustion.

Yet another object of the invention is to configure the firebox to project light and heat forwardly, out from the fireplace.

It is again an object of the invention to enable ready extinguishing of fuel burning inside the firebox.

It is a further object of the invention to support within the firebox artificial logs, branches, and twigs for concealing fuel canisters.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
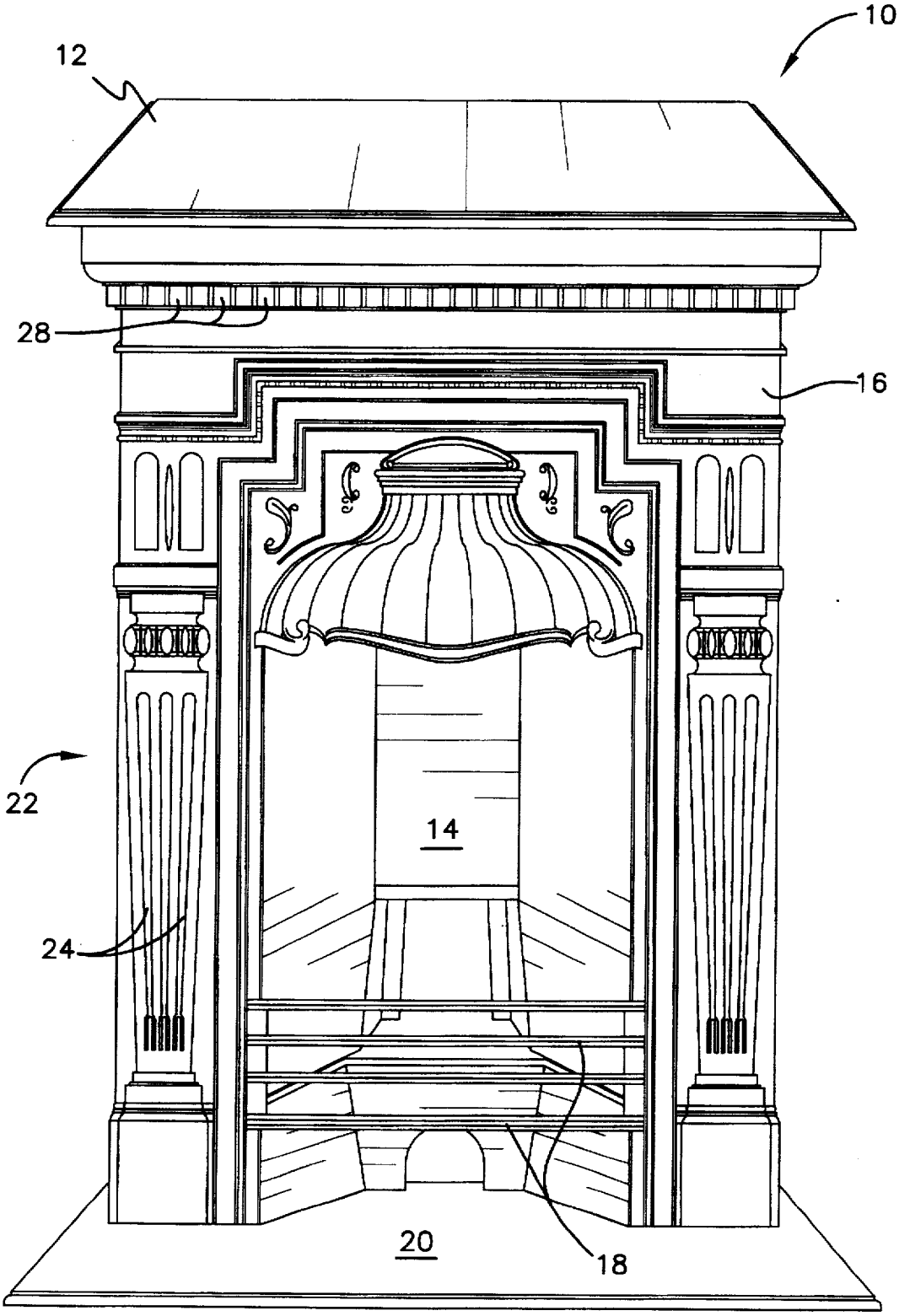
FIG. 1 is a front perspective view of the invention.

FIG. 1 of the drawings shows modular fireplace 10 fully assembled. Fireplace 10 has essential structural features typical of a permanent fireplace (not shown) which fireplace 10 is intended to simulate. The principal features include mantel 12, firebox 14, front face 16, front grate 18, and hearth 20. Novel fireplace 10 is intended to simulate a permanent fireplace both in function and aesthetically. To the latter end, fireplace 10 has general proportions of a permanent fireplace, essentially being greater in height than in width, and being less in depth than in width. Also, fireplace 10 is ornamented in antique or Victorian style, by having bas relief ornamentation formed on its external surfaces. Ornamental features include bas relief columns 22 having grooves or flutes 24, and denticles 28.

In order to be installed in a room or building not originally intended to accommodate a permanent masonry or stone fireplace, novel fireplace must satisfy several requirements. One is that it be modular, so that it can be readily transported and assembled without requiring permanent or intrusive connection to floor and walls of the room in which it is installed. A second requirement is that it be capable of accommodating combustion of a fuel in the open air, without requiring a flue or chimney for exhausting products of combustion. A third requirement is that fireplace 10 be either self-supporting, or readily attachable to an environmental surface.

Figure 2:
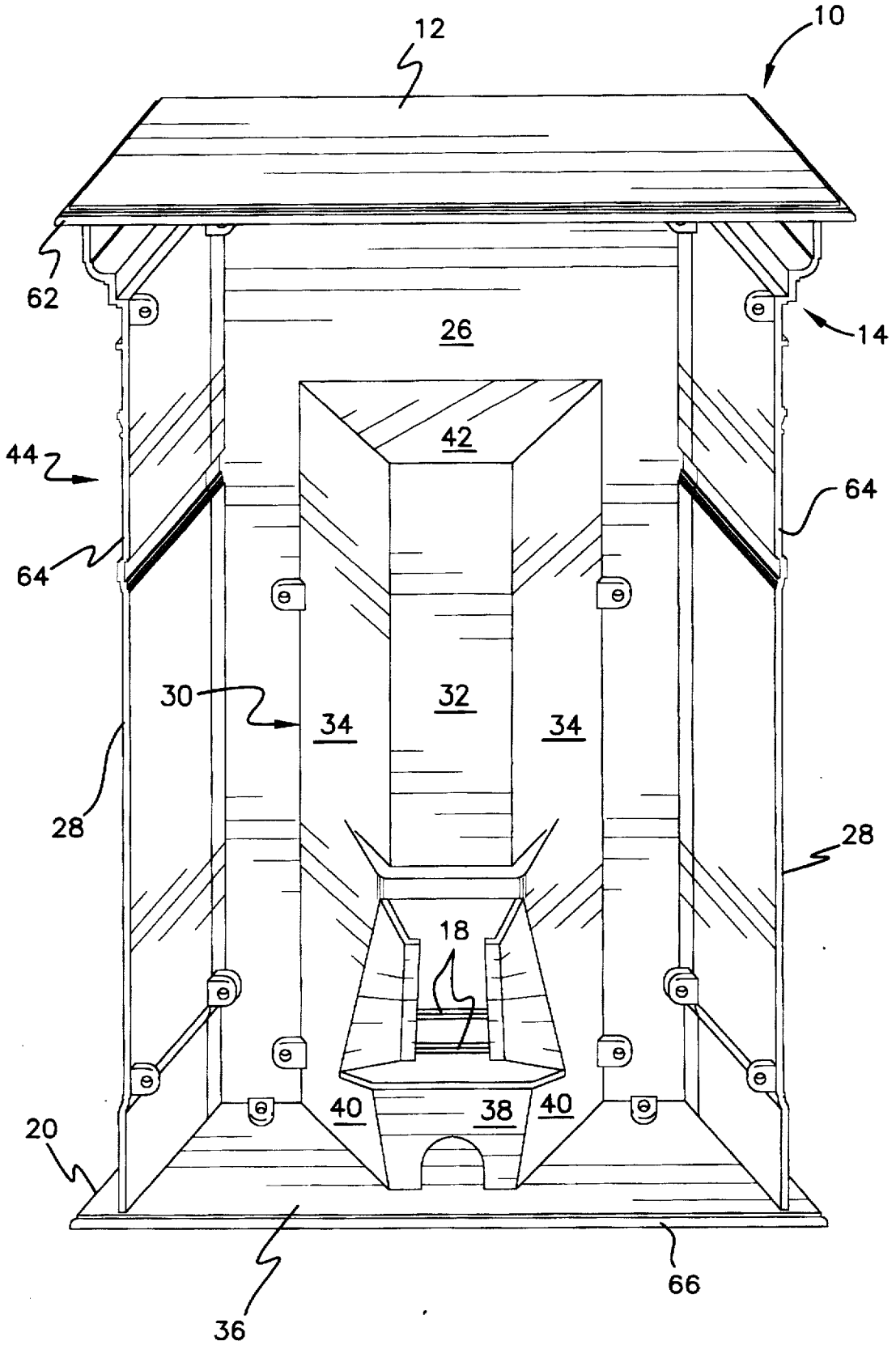
FIG. 2 is a rear perspective view of the invention.

FIG. 2 illustrates the essential modular nature of fireplace 10. Rather than being of massive, thick construction typical of a stone or masonry permanent fireplace, fireplace 10 comprises modules preferably formed from cast metal. These modules have thin walls and are connected together to suggest mass and solidity arising from traditional construction. Visible in FIG. 2 are mantel 12, the rear of a front face member 26, two lateral side members 28, and hearth 20.

Firebox 14 is of unitary construction, and comprises a main firebox member 30 having a rear wall 32 and two lateral walls 34, and including a lower firebox portion 36 having a rear wall 38 and two lateral walls 40. Firebox 14 also includes cover 42.

Figure 3:
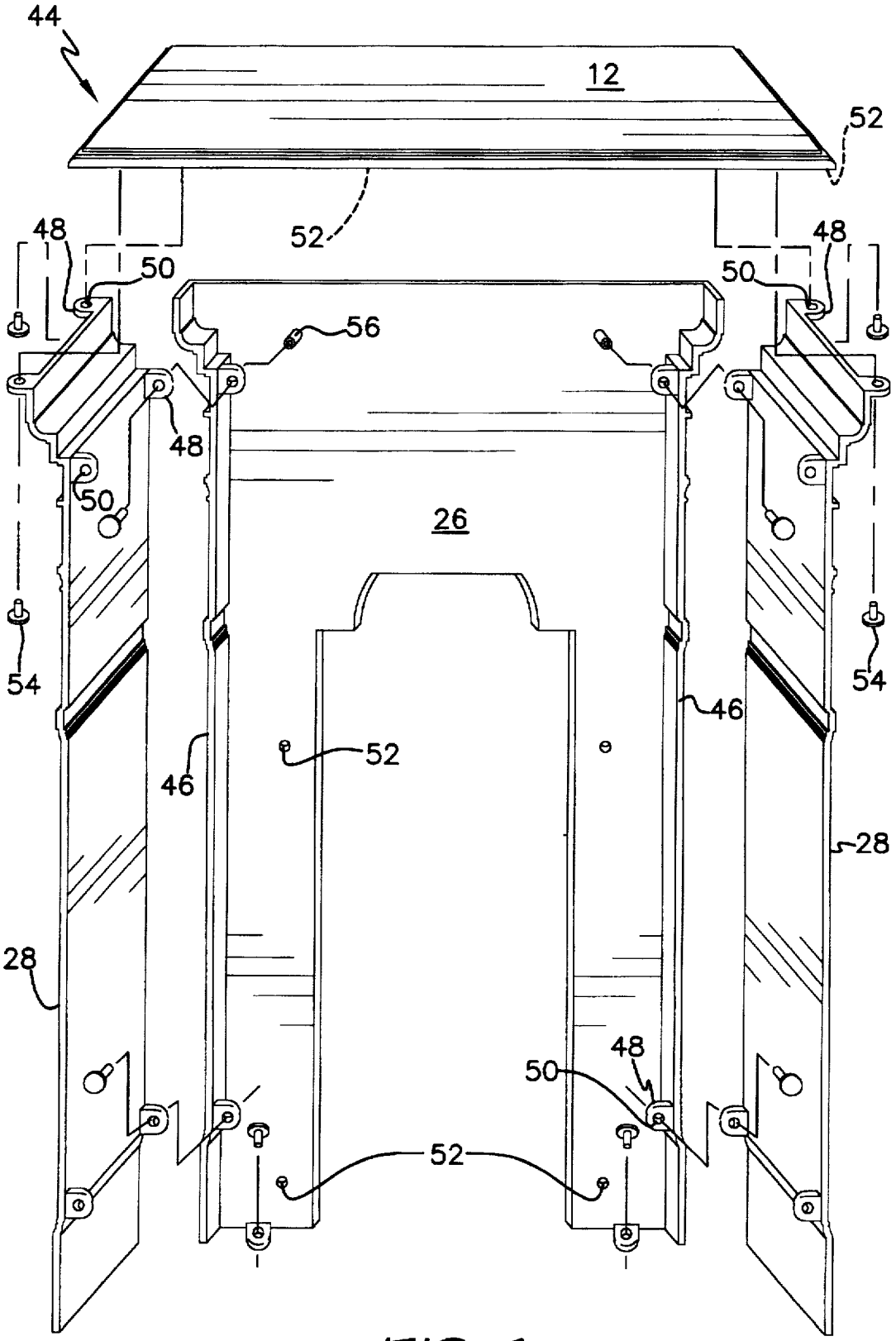
FIG. 3 is an exploded, perspective rear view of the front facade of the invention.

Turning now to FIG. 3, the principal visible, external components, or facade 44, of fireplace 10 are shown spaced apart from one another. Thinness of mantel 12, front face member 26, and lateral side members 28 is apparent in FIG. 3, although face member 26 may include short rearwardly projecting flanges 46. Modular nature of the invention is revealed in FIG. 3. Mantel 12, front face member 26, and lateral side members 28 attach to one another by threaded fasteners at several points of attachment between each two adjacent modular components.

Attachment is preferably by bolts or screws at each point of attachment. Each component has either a protruding tab 48 having a bore 50 extending therethrough or a tapped hole 52 at each point of attachment. When individual modules or components are assembled together as shown in FIG. 2, they are attached by inserting a bolt 54 through bore 50 of a respective tab 48 at each point of attachment.

Figure 4:
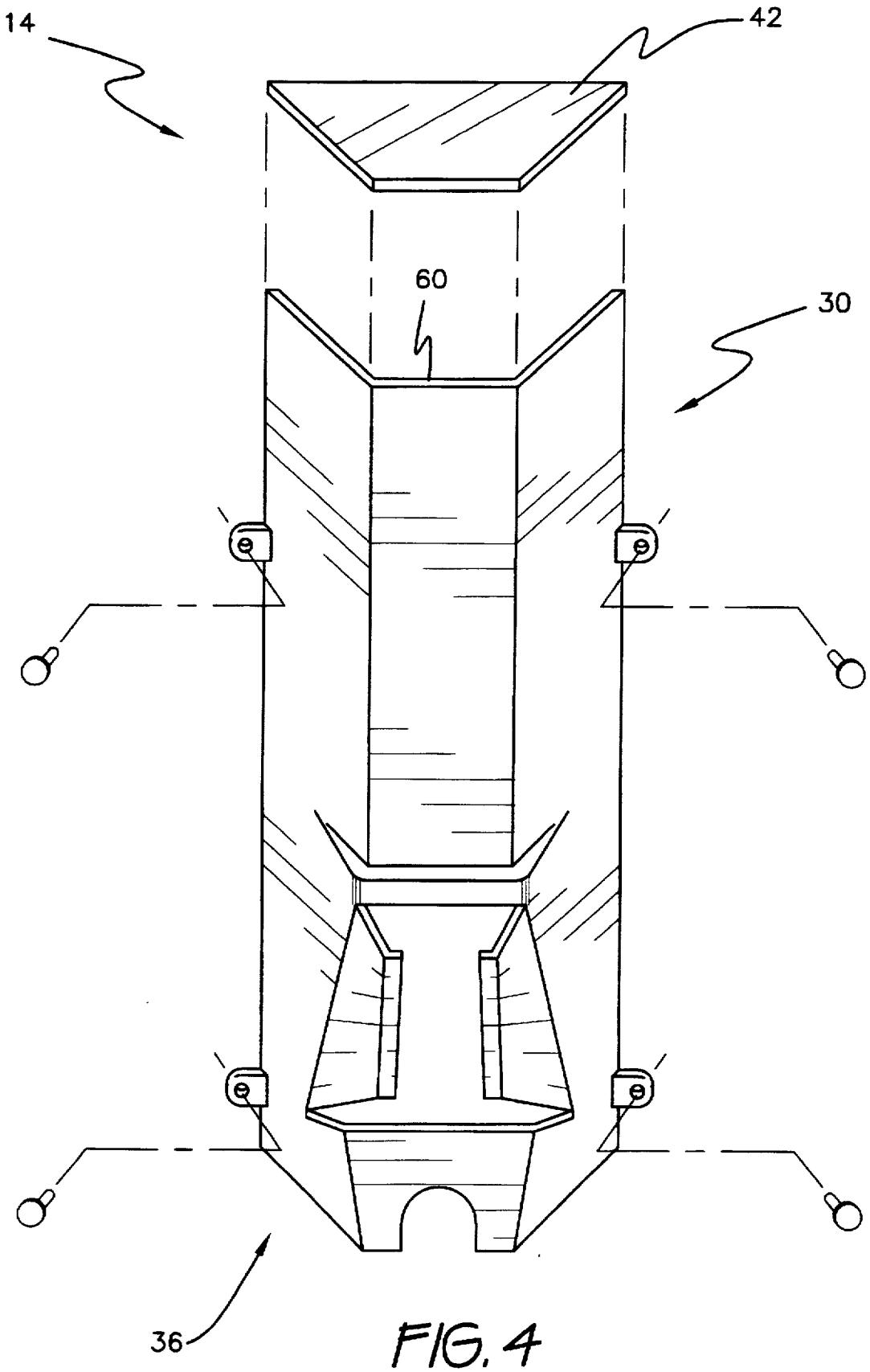
FIG. 4 is an exploded, perspective, rear view of the firebox of the invention.

FIG. 4 shows more of the nature of firebox 14. Main member 30 abuts lower member 36. Similarly, cover 42 abuts but is not joined to main member 30. Main member 30 may be formed to partially interfit cover 42 or lower member 36 or both if desired by forming grooves (not shown) in one of these members. The abutting wall of the other member would be received in these grooves. Abutment without fastening or joining enables firebox members, and particularly cover 42, to be readily removed from firebox 14.

Thus, it will be seen that firebox 14 is itself modular, apart from facade 44. Firebox 14 also has closed construction at its upper surface 60 (see FIG. 4) due to provision of cover 42. Firebox 14 is open to the front surface of fireplace 14. These construction features assure that light and heat generated by combustion will project outwardly from fireplace 10 into the room served thereby. Temperatures at a wall or other environmental surfaces are limited by causing products of combustion to vent to the front of fireplace 10.

At some points of attachment of any one modular component to another, a tab 48 from one modular component aligns with a tab 48 of another modular component. Bolts 54 may pass through aligned bores 50 of these aligned tabs 48. When this method of attachment is employed, a nut 56 is fastened to bolt 54. This type of attachment is utilized to attach face member 26 to each lateral side member 28.

Alternatively, a bolt 54 may be passed through a tab 48 and tightened into a tapped or threaded hole 52. This latter type of attachment is utilized to attach firebox 14 to face member 26. Similar attachment may be utilized to secure mantel 12 to facade 44. As shown in FIG. 3, tabs 48 located at the upper ends of lateral side members 28 may receive bolts 54 which thread into holes 52 formed in mantel 12. Attachment of hearth 20 to facade 44 also utilizes the latter form of attachment wherein bolt 54 tightens into a threaded hole 52.

Attachment set forth above satisfies the requirements that components both be readily joined and also readily removed. Only hand tools are required for assembly and disassembly.

As seen in FIGS. 1 and 2, hearth 20 is disposed beneath facade 44, and extends horizontally beyond facade 44 in all directions. Optionally, extension to the rear of facade 44 is limited so that all rear edges 62, 64, 66 of mantel 12, lateral side members 28, and hearth 20 are coplanar, as shown in FIG. 2. This construction enables fireplace 20 to be located flush against a vertical environmental surface.

Fireplace 10 may be attached in this manner due to provision of tabs 48 on lateral side members 28. As seen in FIG. 3, each lateral side member 28 has two tabs 48 at its upper end, and two tabs 48 at its lower end. Each respective pair of tabs 48 is horizontally aligned with its corresponding tab 48 of the pair.

This construction leads to the following abilities. Firstly, fireplace 10 may be mounted to a vertical environmental surface (not shown), such as a building wall when located flush thereagainst. One upper tab 48 of each lateral side member 28 is utilized to unify facade 44, and the other upper tab 48 is utilized to receive a fastener (not shown) engaging the environmental surface. Similarly, one lower tab 48 of each lateral side member 28 is utilized to unify facade 44, and the other is utilized to receive a second fastener (not shown) engaging the environmental surface. Thus, fireplace 10 is removably attachable to a vertical environmental surface.

The second advantage is that each one of the two lateral side members 28 may be utilized at both the right and left side of fireplace 10. This enables a single mold to form two modular members, thereby eliminating complication from the fabrication process. There is also a slight advantage to assembly, as the person assembling fireplace 10 need not differentiate between a right lateral side member and a left lateral side member.

Combustion apparatus may include any suitable burner (not shown) which burns alcohol either in liquid or gelled form. These fuels are commercially available, and afford the advantage of burning so cleanly that no exhausting of products of combustion is required.

Figure 5:
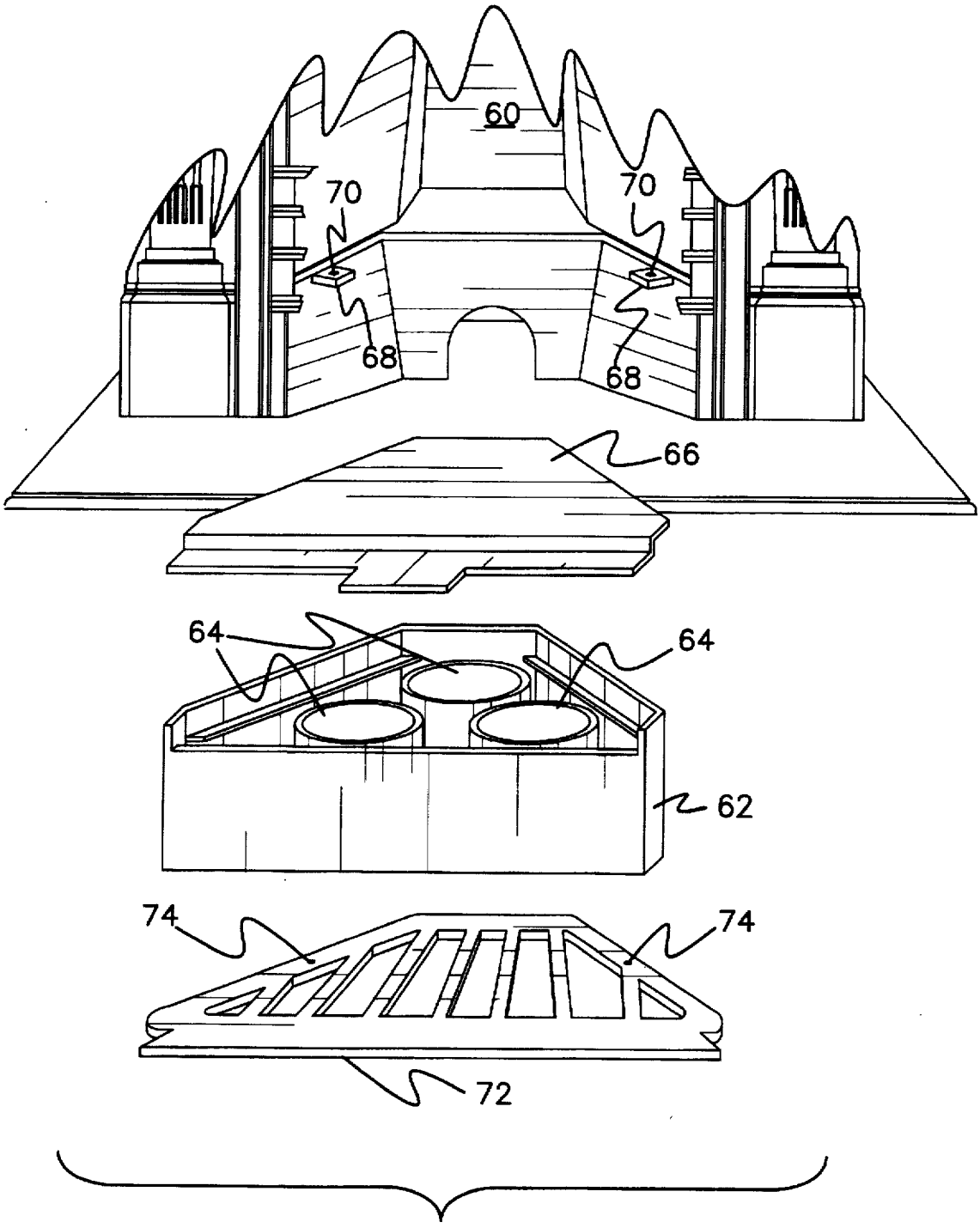
FIG. 5 is a detail view of a firebox of an alternative embodiment of the invention, illustrating a canister holder, a lid for snuffing fire, and a grate for supporting artificial logs, branches, and twigs.

Turning now to FIG. 5, an alternative embodiment of the invention is shown wherein firebox 14 is fully closed at the rear thereof by wall 60. Firebox 14 is dimensioned and configured to cooperate with and receive a fuel canister holder 62 for holding gel fuel canisters 64. Holder 62 has a cap 66 which interfits so as to be horizontally slid into place covering holder 62. This will extinguish or snuff combustion of fuel in all canisters 64. The novel fireplace is dimensioned and configured such that front grate 18 will not interfere with insertion of cap 66 into place from the front of the fireplace.

FIG. 5 also shows tabs 68 each having a hole 70, to enable a horizontal grate 72 to be installed within firebox 58 above fuel canister holder 62. Grate 72 is dimensioned and configured to cooperate and interfit with firebox 58, and has holes 74 for accepting suitable fasteners (not shown) to engage both tabs 68 and holes 74, for securing grate 72 in place within firebox 58. Artificial logs, branches, and twigs (none shown) may then be placed above holder 62 and fuel canisters 64, for concealing holder 62 and canisters 64.

Thus, a modular fireplace readily installable within a room not originally built to accommodate a fireplace is provided. The novel fireplace enables actual combustion open or exposed to persons occupying the room improved by the novel fireplace. Weight of the fireplace is not objectionable to most structures which are improved thereby. The novel fireplace is readily assembled, and is portable since it is readily disassembled into essentially flat modular components.

It should further be noted that the novel fireplace can be converted to traditional usage by eliminating the firebox and incorporating suitable ventilation structure (not shown). Alternatively, the novel fireplace may assume decorative function only by removing or eliminating utilitarian features such as the firebox and grates.

The novel fireplace is susceptible to many variations and modifications which may be introduced by those of skill in the art. The number and arrangement of tabs and holes for assembly may be varied as desired. Accessories for the firebox, such as a burner and a bottom grate, may be provided. Ornamentation may be varied from the details set forth above.

It is to be understood that the present invention is not limited to the embodiments described above, but encompasses any and all embodiments within the scope of the following claims.

I claim:

1. A modular fireplace for accommodating combustion while obviating requirements for exhausting products of combustion, comprising:

a modular facade having a front surface and a rear surface, and comprising a vertical front face member disposed to face forwardly, a right lateral side member and a left lateral side member disposed vertically and adjacent said front face member respectively at right and left sides of said front face member, and a mantel disposed above and covering said front face member, said right lateral side member and said left lateral side member, said front face member having a plurality of first protrusions each bearing a hole for removably attaching said front face member to said right and said left lateral side members, said two lateral side members each having a plurality of second protrusions each bearing a hole for removably attaching said lateral side members to both said front face member and said mantel, and where said mantel has a plurality of third protrusions each bearing a hole for removably attaching said mantel to both said right and said left lateral side member, and where each one of said first protrusions, said second protrusions, and said third protrusions are selectively alienable with another one of said first protrusions, said second protrusions, and said third protrusions for the purpose of receiving a threaded fastener when said facade is assembled; and a firebox disposed within and exposed to said front face member between said right lateral side member and said left lateral side member, said firebox having an upper surface and first attachment means for removably attaching said firebox to said front face member, said firebox having closed construction at said upper surface.

2. The modular fireplace according to claim 1, further comprising a hearth disposed beneath said facade and covering said facade from below, and second attachment means for removably attaching said hearth to said facade, said hearth disposed beneath and extending horizontally beyond said facade in all directions.

3. The modular fireplace according to claim 1, said facade having external surfaces and bas relief ornamentation formed on said external surfaces.

4. The modular fireplace according to claim 1, said facade having second attachment means for removably attaching said facade to a vertical environmental surface.

5. The firebox according to claim 1, further comprising a fuel canister holder insertable into said firebox and a cap interfitting with said fuel canister holder, said firebox dimensioned and configured to cooperate with and receive said fuel canister holder and to accept sliding said cap into place onto said fuel canister holder, said cap for extinguishing combustion of fuel within said canisters.

6. The modular fireplace according to claim 5, further comprising a horizontal grate dimensioned and configured to cooperate and interfit with said firebox, said grate disposed over said fuel canister holder, and said firebox having means for receiving fasteners for installing said horizontal grate therein.

7. A modular fireplace for accommodating combustion while obviating requirements for exhausting products of combustion, comprising:

a modular facade having a front surface and a rear surface, and comprising a vertical front face member disposed to face forwardly, a right lateral side member and a left lateral side member disposed vertically and adjacent said front face member respectively at right and left sides of said front face member, and a mantel disposed above and covering said front face member, said right lateral side member and said left lateral side member, said front face member having a plurality of first protrusions each bearing a hole for removably attaching said front face member to said right and said left lateral side members, said two lateral side members each having a plurality of second protrusions each bearing a hole for removably attaching said lateral side members to said mantel, and where said mantel has a plurality of third protrusions each bearing a hole for removably attaching said mantel to said right and said left lateral side members, each one of said first protrusions, said second protrusions, and said third protrusions being alienable with another one of said first protrusions, said second protrusions, and said third protrusions for the purpose of receiving a threaded fastener when said facade is assembled; and a firebox disposed within and exposed to the front of said facade between said right lateral side member and said left lateral side member, said firebox having an upper surface and first attachment means for removably attaching said firebox to said facade, said firebox having closed construction at said upper surface, and where said firebox includes;

a rear wall and two lateral side walls, and said firebox further includes a cover disposed above said rear wall and said lateral walls, said cover being horizontally oriented and disposed to close said firebox from above, said cover having means for removing said cover from said main firebox member.

* * * * *